United States Patent [19]

Haüser

[11] Patent Number: 4,778,954

[45] Date of Patent: Oct. 18, 1988

[54] SWITCHING DEVICE TO BE OPERATED BY MEANS OF A CYLINDER LOCK

[75] Inventor: Herbert P. Haüser, Elsdorf-Heppendorf, Fed. Rep. of Germany

[73] Assignee: DOM Sicherheitstechnik GmbH & Co. KG, Bruhl, Fed. Rep. of Germany

[21] Appl. No.: 109,666

[22] Filed: Oct. 16, 1987

[30] Foreign Application Priority Data

Oct. 31, 1986 [DE] Fed. Rep. of Germany ... 8629032[U]

[51] Int. Cl.[4] ..... H01H 27/06

[52] U.S. Cl. ..... 200/43.08; 200/43.11

[58] Field of Search ..... 200/43.08, 43.04, 43.11, 200/43.16, 43.07

[56] References Cited

U.S. PATENT DOCUMENTS

| | | | |
|---|---|---|---|
| 2,004,207 | 6/1935 | Laplante | 200/43.04 |
| 3,427,413 | 2/1969 | Hawkins | 200/43.08 |
| 3,936,673 | 2/1976 | Kelly et al. | 200/43.08 |
| 4,398,067 | 8/1983 | Rubinstein et al. | 200/43.11 |

FOREIGN PATENT DOCUMENTS

| | | | |
|---|---|---|---|
| 2637639 | 2/1978 | Fed. Rep. of Germany | 200/43.08 |

*Primary Examiner*—Renee S. Luebke

*Attorney, Agent, or Firm*—Barry E. Deutsch

[57] ABSTRACT

A switching device to be operated by means of a cylinder lock, comprising a switching element mounted for rotation on the core of the cylinder lock. Said switching element is adapted to move a spring-loaded contact pin from its operating position in contact with the actuating surface of an electrical switch and to lock it against returning to said operating position.

6 Claims, 3 Drawing Sheets

FIG. 1
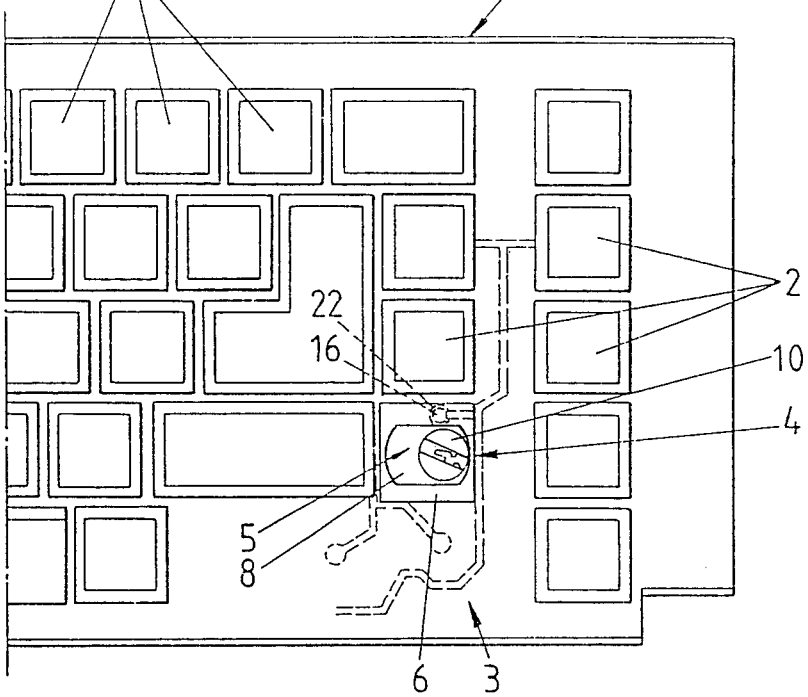
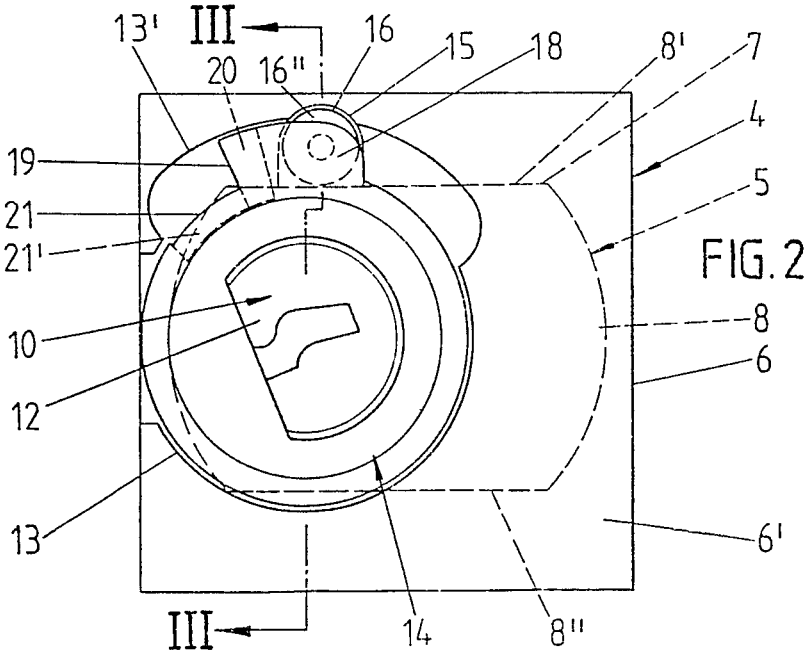
FIG. 2

FIG. 3
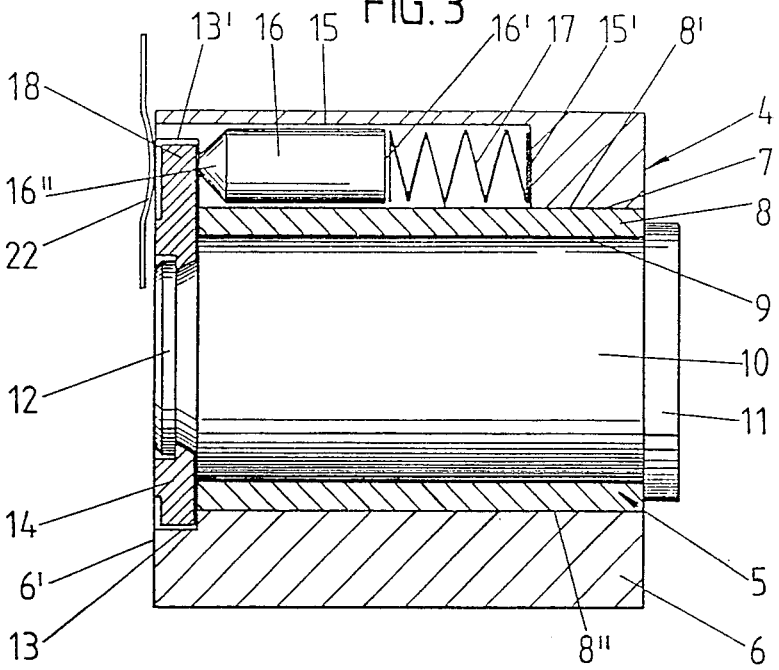
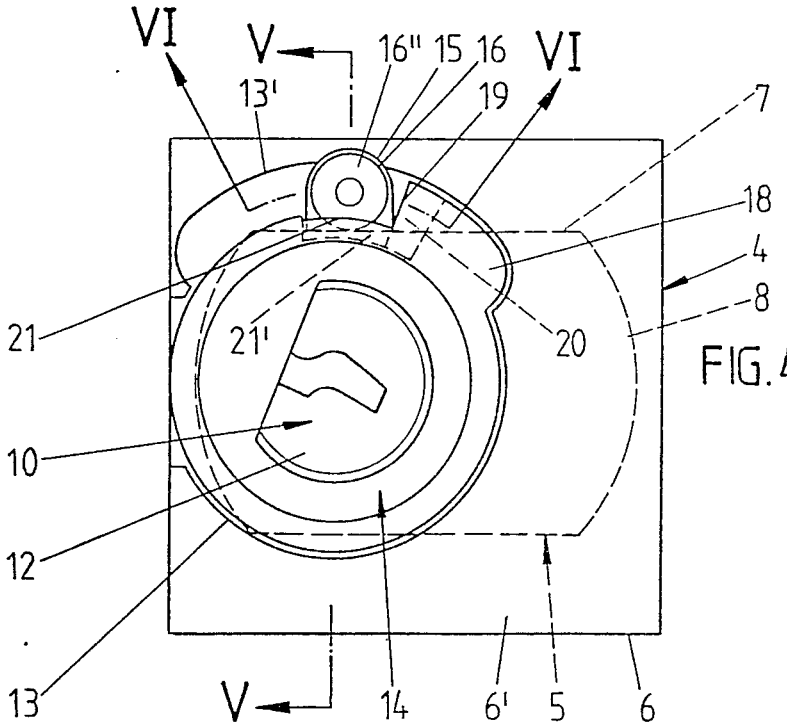
FIG. 4

SWITCHING DEVICE TO BE OPERATED BY MEANS OF A CYLINDER LOCK

BACKGROUND OF THE INVENTION

The present invention relates to a switching device to be operated by means of a cylinder lock, which device comprises a switching element mounted for rotation on the core of the cylinder lock.

Known switching devices of this type are designed so that, by turning the core of the cylinder lock, the switching element mounted thereon contacts the actuating surface of, for example, an electrical switch. This means that the force of impact of the contact element on the actuating surface is dependent on the force used to operate the switch. If too much force is used, this can result in damage to the switching device.

BRIEF SUMMARY OF THE INVENTION

An object of the present invention is therefore to provide, in a form which is simple and economic to produce in practice, a switching device in which the actuating surface of the switch is contacted at all times with the same, predetermined, force.

The invention provides a switching device to be operated by means of a cylinder lock comprising a switching element mounted for rotation with the core of the cylinder lock, characterised in that the switching element is adapted to move a contact pin loaded by a spring from its operating position in contact with the actuating surface of an electrical switch and to lock it against returning to the operating position. The force applied to the cylinder lock no longer determines the force of impact of the switching element on the actuating surface of the electrical switch, since the force of impact is now determined by the spring acting on the contact pin. If the switching element is moved, by turning the key, out of the position in which it restrains the contact pin, the pin is displaced towards the actuating surface of the electrical switch by the spring. Therefore, the spring alone determines the force with which the actuating surface of the electrical switch is contacted. By selection of a suitable spring, the most suitable force of impact for any particular purpose can be predetermined. In particular, for very delicate or sensitively responding switches, this results in the switching operation being carried out smoothly and controllably, and having increased switch life.

By turning the cylinder core, together with the switching element, in the opposite direction, the contact pin is retracted from the actuating surface of the electrical switch and the spring is compressed.

In a preferred embodiment of a device according to the invention, the contact pin is located with its axis parallel to the axis of the cylinder core. This parallel axis arrangement of the contact pin and the cylinder core allows for a space-saving construction of the device, and also makes it possible for a long-dimensioned spring to be used. The contact pin and the spring are located in the block-shaped housing accommodating the cylinder lock.

Preferably in a device according to the invention, the switching element mounted on the cylinder core is in the form of a shaped collar of greater diameter than the core and has a run-up bevel on the flank facing the contact pin. The provision of this run-up bevel allows smooth closing of the switch. Because the switching element is designed as a shaped collar, the end of the contact pin is easily accessible at the rear end of the cylinder lock.

The end of the contact pin which makes contact with the actuating surface of the electrical switch is preferably of frusto-conical shape, which reduces the area of contact of the contact pin on the actuating surface of the electrical switch, and further improves the smooth closing of the switch.

Preferably in a device according to the invention, the switching element is provided with a curved ridge running concentric with the cylinder core, which ridge retains the contact pin in its operating position. While the contact pin can protrude when the switching element is in the operating position, the extent of the protrusion is determined by the curved ridge. Therefore, the contact pin cannot accidentally come out of its housing. Since the run-up bevel is not required to secure the contact pin its operating position, the bevel can be positioned so that it is at an angular displacement from the contact pin when the pin is in this operating position. Any movement of the contact pin is therefore always dependent on a predetermined angular turn of the cylinder core and hence the switching element. The run-up bevel of the switching element only operates on the contact pin, by retracting it and lifting its contacting face from the actuating surface of the electrical switch, after the switching element has been rotated through this predetermined angle.

The device according to the invention is of particular advantage when used in conjunction with a foil keyboard. As the actuating surface is always contacted with a predetermined force, there is no risk of damage to the foil keyboard.

BRIEF DESCRIPTION OF THE DRAWINGS

The invention will now be further described with reference to FIGS. 1 to 6 of the accompanying drawings, in which:

FIG. 1 is a partial top view of a keyboard provided with a foil keyboard with associated switching device, in which the contact pin is in an off position;

FIG. 2 is a rear view, in an enlarged projection, of the block-shaped housing accommodating the cylinder lock in which the contact pin is in an off position;

FIG. 3 is a cross-sectional view taken along line III—III in FIG. 2;

FIG. 4 is a representation corresponding to FIG. 2, in which the contact pin has been pushed forward into its operating position by turning of the cylinder core;

DETAILED DESCRIPTION

Figure 5:
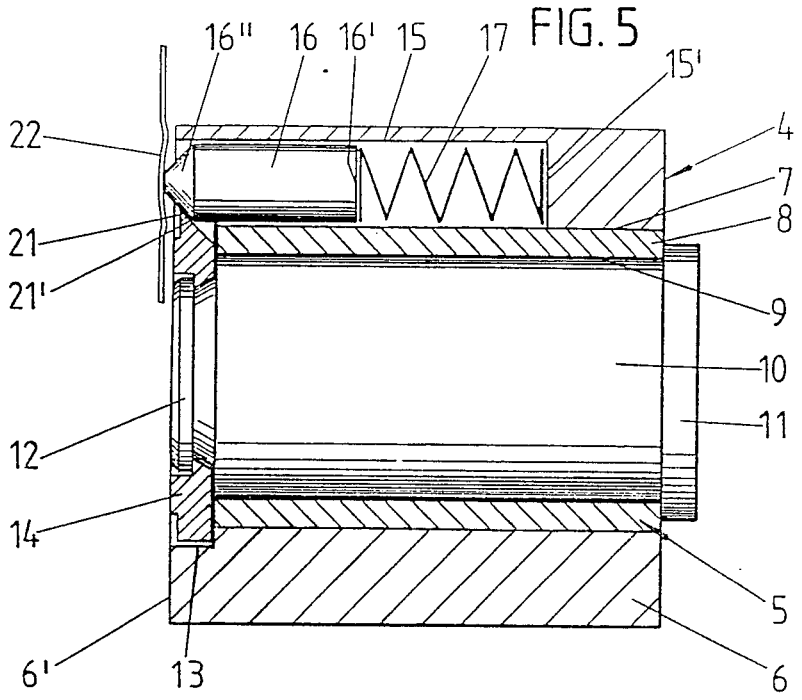
FIG. 5 is a cross-sectional view taken along line V—V in FIG. 4, in which the contact pin contacts the actuating face of the foil keyboard

In FIG. 1 a partially depicted keyboard 1 is illustrated. The keyboard 1 has keys for impinging a foil keyboard 3. The keyboard is equipped with a switching device 4, which is contained in a housing 6 of rectangular shape accommodating a cylinder lock 5. The outline of the block-shaped housing 6 conforms approximately to the base area of a normal key 2.

The cylinder lock 5 comprises a cylinder housing 8 which is fitted into an opening 7 of the housing 6 and which holds a cylinder core 10 so that it can rotate inside a bore 9. At its front end the cylinder core 10 is provided with a collar 11 of enlarged diameter, which abuts the front face of the cylinder housing 8. The rearward end 12 of the cylinder core 10 is flush with the rearward face 6' of the block-shaped housing 6. A recess 13 is machined into this rearward face 6', running concentric with the axis of the cylinder core and comprises a widened cut-out 13'. This recess 13 plus the cut-out 13' accommodate a switching element 14 located at the rear face 6' of the cylinder core 10. This switching element 14 is in the form of a shaped collar attached to the rear end of the cylinder core 12 by a clip connection.

The cylinder housing 8 is flattened at both sides so that the flattenings 8', 8 " run parallel with the corresponding side walls of the block-shaped housing 6. The cut-out 13' is adjacent to the flattening 8'. In the central region of the cut-out 13' a longitudinal channel 15 with its axis parallel to the axis of the cylinder core is broken in from the rearward face 6' of the block-shaped housing 6. The channel 15 is open towards the opening 7. The longitudinal hole 15 accommodates a contact pin 16 and a compression spring 17, which spring 17 rests at one end against the end face 15' of the longitudinal channel 15 and at the other end against the bottom face 16' of the contact pin 16. The other end of the contact pin 16 is of frusto-conical shape and is numbered 16".

The switching element 14 constructed as a shaped collar on the cylinder core, is provided with a radially-extending projection 18, which moves through the cut-out 13' of the recess 13 when the cylinder core is turned. On the flank 19 facing the contact pin 16 the projection 18 is designed to form a run-up bevel 20 facing the wall of the cut-out 13". Its angle corresponds with the taper of the apex of the cone 16", as can be seen in particular, in FIG. 6.

The flank 19 is further adjoined by a curved ridge 21 running concentric with the cylinder core. From the ridge 21 extends a support shoulder 21' sloping in the direction of the wall of the cut-out l3".

In FIGS. 1 to 3, the switching device is shown in the "off" position. The switching element 14 is positioned so that the contact pin 16 is restrained by the projection 18 of the switching element 14 from moving forward. In this position, the key, which is not shown, can be withdrawn from the lock.

Figure 6:
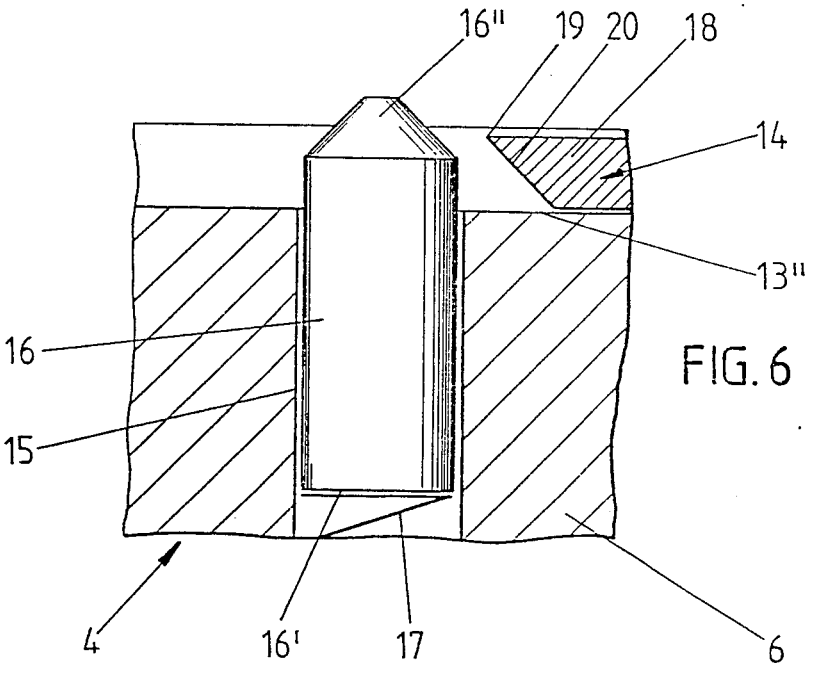
FIG. 6 is a cross-sectional view taken along line VI—VI in FIG. 4, in a greatly enlarged projection.

In order to switch the keyboard on, the cylinder core 10 is turned by means of the associated key from the position shown in FIG. 1, in an anti-clockwise direction limited by a stop, so that the position shown in FIGS. 4 to 6 is obtained. Since FIG. 4 is a rear view, it follows that the cylinder core 10 together with its switching element 14 was turned in the clockwise direction in the perspective shown there. The projection 18 of the contact element 14 is moved during this turning within the cut-out 13', and moves out of the way of the contact pin 16 in the final phase of the turn, so that the latter is able to advance into the position as shown in FIG. 5 when acted upon by the spring. As a result, it impinges the actuating surface 22 of the foil keyboard 3 and initiates the switching operation. The advancement of the contact pin 16 and/or the impingement of the actuating surface 22 is thus unaffacted by the force with which the cylinder core 10 is turned. The spring 17 alone controls the advancement of the pin 15 so that the actuating surface 22 of the foil keyboard 3 is always contacted with the same force.

Movement of the contact pin 16 in the direction of the actuating surface 22 is, however, restricted by the sloping support shoulder 21' departing from the curved ridge 21, as can be seen in FIGS. 4 and 5. In this operating position the key can also be withdrawn if this is necessary. As can be seen from FIGS. 4, the flank 19 lies at a distance from the contact pin 16. Unintentional, slight, twisting of the cylinder core 10 together with the switching element 14 does not lead to any displacement of the contact pin 16. The switching element 14 always has to be displaced by a certain angle of rotation, for the contact pin 16 to be moved out of contact with the actuating surface 22 by the run-up bevel 20 of the switching element 14 camming the face of the cone 16" against the spring 17. In the completly compressed position, the projection 18 of the switching element 14 again covers the contact pin 16 and restrains it from returning into the operating position.

I claim:

1. A switching device comprising:

a cylinder lock having a rotatable core;

a switching element mounted for rotation with the core of said cylinder lock and having a radial projection extending circumferentially for a segment of said element;

a spring loaded contact pin having an operative position contacting an electric switch actuating surface and an inoperative position whereat said pin is disengaged from said switch actuating surface, said radial projection being rotated into engagement with said contact pin to move said pin from its operative position to its inoperative position and to lock said pin in its inoperative position against returning to its operative position.

2. The switching device of claim 1 wherein said contact pin is located with its axis parallel to a longitudinally extending axis of said core of said cylinder lock.

3. A switching device of claim 1 wherein said switching element is mounted on said core and is designed as a shaped collar of greater diameter than said core and is provided with a run-up bevel on a flank portion facing said contact pin.

4. A switching device of claim 1 wherein an end of said contact pin adapted to contact said electric switch actuating surface is of frusto-conical shape.

5. The switching device of claim 1 wherein said contact pin and a spring associated therewith are disposed in a block-shaped housing accommodating said cylinder lock.

6. The switching device of claim 1 wherein said switching element is provided with a curved ridge running concentric with said core, which ridge is adapted to retain said contact pin in an axially extending channel of said housing in said operative position.

* * * * *